US005901460A

United States Patent [19]

Carter et al.

[11] Patent Number: 5,901,460

[45] Date of Patent: May 11, 1999

[54] AUTOMATIC SYSTEM FOR DRYING HIGH MOISTURE CONTENT MATERIAL FROM A SOURCE

[75] Inventors: Brad J. Carter, Northfield, Vt.; Robert A. Caughey, deceased, late of Antrim, N.H.; by Jason Warner, legal representative, Needham, Mass.

[73] Assignee: Kessel/Duff Corporation, Williston, Vt.

[21] Appl. No.: 08/636,166

[22] Filed: Apr. 22, 1996

[51] Int. Cl.[6] ..... F26B 19/00; F26B 21/06; F26B 13/10

[52] U.S. Cl. ..... 34/216; 34/545; 34/547; 34/560; 34/573

[58] Field of Search ..... 34/216, 165, 236, 34/524, 526, 543, 545, 547, 560, 562, 573, 498, 178, 179, 181

[56] References Cited

U.S. PATENT DOCUMENTS

| | | | |
|---|---|---|---|
| 3,064,357 | 11/1962 | Butters | 34/560 |
| 3,989,470 | 11/1976 | Czurak et al. | 23/259.3 |
| 4,888,885 | 12/1989 | Caughey | 34/33 |
| 5,079,852 | 1/1992 | Nakayama et al. | 34/44 |
| 5,423,891 | 6/1995 | Taylor | 48/197 R |

FOREIGN PATENT DOCUMENTS

| | | | |
|---|---|---|---|
| 2386794 | 11/1978 | France | 34/560 |

*Primary Examiner*—William Doerrler
*Attorney, Agent, or Firm*—Iandiorio & Teska; Brian J Colandreo

[57] ABSTRACT

An automatic system for drying high moisture content material from a source. The system includes a dryer enclosing a bed inclined upwards from the bottom portion thereof to the top portion thereof, and a slat and picker drive motor for urging material downward from the top portion to the bottom portion of the bed. A first material feed system transports the high moisture content material from the source to the top portion of the bed, and includes a surge bin disposed between the source and the dryer for assuring a constant supply of material to the dryer for constant operation thereof. There are sensors for detecting the amount of material delivered to the surge bin; and a controller, responsive to the sensors, which adjusts the rate of material transferred from the surge bin to the dryer and the rate material is processed through the dryer.

69 Claims, 7 Drawing Sheets

AUTOMATIC SYSTEM FOR DRYING HIGH MOISTURE CONTENT MATERIAL FROM A SOURCE

FIELD OF INVENTION

This invention relates to an automatic system for drying high moisture content material from a source such as the sludge by-product of a paper mill.

BACKGROUND OF INVENTION

The waste product of papermills, commonly called sludge, comprises approximately 98% moisture. A belt press may be used to press some of the moisture out of the sludge before disposal but the waste material taken to the landfill still often contains as much as 70% moisture. Since landfills generally charge by the pound, it is consequently very expensive to dispose of the sludge.

The prototype gravity fed dryer shown in U.S. Pat. No. 4,888,885 (incorporated herein by this reference) was designed to dry this type of high water content material but, for a number of reasons, was found to be unsuitable for inclusion into a commercial paper manufacturing facility.

First, a typical paper plant facility often operates and therefore generates sludge 24 hours a day. The gravity fed system shown in the '885 patent requires manpower to feed the dryer and discharge the dried material. Second, the quantity of sludge produced by a commercial paper mill varies over time. Thus, without some means of assuring a constant feed to the dryer shown in the '885 patent, there will be times that the dryer is not working efficiently or not drying material at all requiring inefficient shut down/start-up cycles. Worse, there may be times when the dryer cannot handle the large amount of material fed to it.

Third, the quality of sludge (fiber, filler, and moisture content) produced by the mill varies over time. The paper mill may be set up to produce a high quality bond paper one day, cigarette paper the next day, and a cardboard type paper at other times. The sludge from different types of paper has different qualities. In the '885 patent disclosure, there is no way to control the operating parameters of the dryer (e.g., processing time, air temperature, pressure heads), and consequently it was found unsuitable for use in actual commercial paper mills. Use of the dryer shown in the '885 patent resulted in an end product which may not be dry enough, or too dry resulting in a waste of energy.

SUMMARY OF INVENTION

It is therefore an object of this invention to provide a completely automatic system for drying high moisture content material from a source such as a paper mill.

It is a further object of this invention to provide such a system which operates automatically 24 hours a day with a minimum of human input.

It is a further object of this invention to provide such an automatic system which assures a constant feed to the dryer thereby assuring efficient operation of the system.

It is a further object of this invention to provide such a system which automatically handles different types of sludge produced by the paper mill.

It is a further object of this invention to provide such a system which automatically senses and adjusts itself to handle different quantities and qualities of sludge produced by the paper mill.

It is a further object of this invention to provide such an automatic system which can be used for drying high moisture content material from sources including paper mills to reduce the cost of the disposal of such material.

It is a further object of this invention to provide such an automatic system which adequately dries high moisture content material to the point that the dry material can be burned as a fuel.

It is a further object of this invention to provide such an automatic system which adequately dries high moisture content material to the point where it can be used again as feed stock for a paper mill.

It is a further object of this invention to provide such an automatic system which efficiently manages the amount of energy input to the system to maximize the drying process.

This invention results from the realization that an efficient, continuously operable, and automatic system for drying high moisture content material is accomplished by a surge bin placed between the sludge output of a paper mill and the input of the dryer subsystem which dries the sludge; a dryer subsystem which automatically and continuously handles the variable quantities and qualities of sludge output from the paper mill; a mechanical drive subsystem which urges the sludge through the dryer at variable rates; a material feed subsystem which can be operated at different feed speeds; a set of sensors placed at strategic points throughout the system; and a controller which automatically triggers the operation of dryer drive subsystem and the material feed subsystem in response to signals from the sensors indicative of different quantities and qualities of sludge to be processed.

In this way, the waste material is continuously and automatically dried independent of the quantity and quality of the sludge supplied from the paper mill thereby both eliminating wasted heat when no sludge is available for processing and overloading conditions when too much sludge is presented for processing.

This invention features an automatic system for drying high moisture content material from a source. The system includes a dryer including a bed inclined upwards from the bottom portion thereof to the top portion thereof, and drive means for urging material downward from the top portion to the bottom portion of the bed and a first material feed system for transporting the high moisture content material from the source to the top portion of the bed. The first material feed system includes a surge bin disposed between the source and the dryer for assuring a constant supply of material to the dryer for constant operation thereof. There are means for detecting the amount of material delivered to the surge bin, and a controller, responsive to the means for detecting, including means for adjusting the rate of material transferred from the surge bin to the dryer. In one embodiment, there is also a second material feed system for transporting back to the surge bin any excess material delivered by the first material feed system to the top portion of the dryer.

The means for detecting typically includes means for sensing any excess material transferred by the second material feed system back to the surge bin. The controller is connected to the means for sensing and the dryer drive means and the controller operates the dryer drive means only when excess material is detected being delivered back to the surge bin. The means for detecting also typically includes means for sensing the amount of material in the surge bin. The first material feed system is operable at least two speeds and the controller includes means for switching between the two speeds in response to the amount of material in the surge bin thereby assuring constant operation of the dryer independent of the output from the source.

The dryer bed may include a series of slats disposed longitudinally along the length of the bed, alternate slats being slidable with respect to adjacent slats, and the drive means includes means for propelling the slidable slats back and forth to shuffle material on the bed downward. The controller includes means for operating the means for propelling for variable periods of time. The adjacent slats preferably overlap each other for preventing material from falling into the bottom of the dryer. The adjacent slats also define longitudinal air gaps therebetween for passing air through material disposed on the bed. The drive means further includes a picker mechanism disposed along the bottom portion of the bed for discharging material off the bottom portion of the bed and a motor for operating the picker mechanism. The controller includes means for operating the picker motor for variable periods of time.

In a preferred embodiment, the dryer bed includes a series of slidable slats disposed longitudinally along the length of the bed and a slat drive motor for propelling the slidable slats back and forth to shuffle material on the bed downward. The means for detecting then includes means for sensing when the top portion of the bed contains sufficient material to be dried, the controller is connected to the slat drive motor and the means for sensing, and the controller operates the slat drive motor only when the means for sensing indicates that the top portion of the bed contains sufficient material to be dried. The means for detecting also preferably includes means for signaling two different amounts of material in the surge bin, and the controller is connected to the slat drive motor and the means for sensing. The controller operates the slat drive motor for a first period of time in response to a signal indicative of a first amount of material in the surge bin and for operating the slat drive motor for a second period of time in response to a signal indicative of a second amount of material in the surge bin.

If the dryer further includes a picker mechanism disposed along the bottom of the bed for discharging material off the bottom portion of the bed and a motor for operating the picker mechanism, the means for detecting includes means for sensing when the top portion of the bed contains sufficient material to be dried, the controller is connected to the picker drive motor and the means for sensing, and the controller operates the picker drive motor only when the means for sensing indicates that the top portion of the bed contains sufficient material to be dried. The means for detecting also usually includes means for signaling two different amounts of material in the surge bin, the controller is connected to the picker drive motor and the means for sensing, and the controller operates the picker drive motor for a first period of time in response to a signal indicative of a first amount of material in the surge bin and for operating the picker drive motor for a second period of time in response to a signal indicative of a second amount of material in the surge bin.

In a preferred embodiment, the system also includes a sensor for signaling an overfilled surge bin, a sensor for signaling an empty surge bin, and a sensor for signaling an overfilled disposal site. The sensors are all connected to the controller and the controller sets an idle condition or a shut-down condition in response to a signal from any one the sensors.

In a preferred embodiment, there is a timer for counting the time between successive full conditions of the dryer bed and means for adjusting the operating time of the dryer's slat drive and picker drive motors in response to the counter.

The system further includes a hot air generator connected to the dryer including means for supplying variable temperature hot air to the bottom surface of the bed and means for sensing the temperature of the hot air supplied. The controller compares the temperature of the hot air with an optimal temperature and adjusts the means for supplying until the temperature of the hot air is approximately the same as the optimal temperature.

There are also means for sensing the temperature of the top surface of the bed. The controller compares the temperature of the top surface of the bed with an optimal temperature, and adjusts the slat and picker drive motor speed or periodicity until the optimal temperature is reached, achieving uniform dryness of the material discharged from the system over time. When the slat and picker drives are at their maximum settings, the controller adjusts the supply air temperature downward until the over bed optimum temperature is reached, thereby avoiding over dryness of the discharged product and conserving energy. There are also means for sensing the flow rate of air through the bed. The controller compares the flow rate through the bed with an optimal flow rate and adjusts the flow rate until the optimal flow rate is reached.

The invention also features an automatic system for drying high moisture content material from a source, the system comprising: a dryer including a bed inclined upwards from the bottom portion thereof to the top portion thereof and a drive mechanism for urging material downwards from the top portion of the bed to the bottom portion of the bed at first and second rates; a surge bin containing source material to be dried; a material feed system for transporting source material from the surge bin to the top portion of the bed at first and second speeds; a first detector for providing signals indicative of first and second quantities of source material in the surge bin; a second detector for providing a signal indicative of sufficient source material present at the top portion of the bed; and a system controller connected and responsive to the first and second detectors and connected to and for operating the drive mechanism and the first material feed system. The controller includes means, responsive to a signal from the first detector indicative of the first quantity, for operating the material feed system at the first speed and for operating the drive mechanism at the first rate, and, responsive to a signal from the first detector indicate of the second quantity, for operating the material feed system at the second speed and for operating the drive mechanism at the second rate; and means, responsive to the second detector, for independently operating the drive mechanism only when the second detector provides a signal indicative of sufficient source material present at the top portion of the bed.

The controller further includes means for counting the time between operations of the drive mechanism and for varying the preset first and second rates in response to a counted time differing from a preset value.

This invention also features an automatic system for drying high moisture content material from a source, the system comprising: a dryer including a bed inclined upwards from the bottom portion thereof to the top portion thereof and a drive mechanism for urging materials downwards from the top portion of the bed to the bottom portion of the bed at first and second rates; a surge bin containing source material to be dried; a material feed system for transporting source material from the surge bin to the top portion of the bed; a first detector for providing signals indicative of first and second quantities of source material in the surge bin; a second detector for providing a signal indicative of sufficient source material present at the top portion of the bed; and a system controller connected and responsive to the first and second detectors and connected to and for operating the drive mechanism. The controller includes means, responsive to a signal from the first detector indicative of said first quantity, for operating said drive mechanism at the first rate; and responsive to a signal from said first detector indicative of the second quantity, for operating the drive mechanism at the second rate; and means, responsive to said second detector, for operating the drive mechanism only when the second detector provides a signal indicative of sufficient source material present at the top portion of the bed.

This system further includes counter means for timing the rate of signals indicative of sufficient source material, the controller further including means for varying the drive mechanism's first and second rate in response to the counter means. Further included is a third detector for providing a signal indicative of the temperature of the air over the dryer bed, the controller further including means for varying the drive mechanism's first and second rate in response to the temperature of the air over the drier bed.

This invention also features a system comprising a dryer including a bed inclined upwards from the bottom portion thereof to the top portion thereof; a surge bin containing source material to be dried; a material feed system for transporting source material from the surge bin to the top portion of the bed at first and second speeds; a detector for providing signals indicative of first and second quantities of source material in the surge bin; and a system controller connected and responsive to the first detector and connected to and for operating the material feed system. The controller includes means, responsive to a signal from the detector indicative of the first quantity, for operating the material feed system at the first speed and, responsive to a signal from the detector indicative of the second quantity, for operating the material feed system at the second speed.

Finally, this invention features an automatic system for drying high moisture content material from a source. There is a dryer including a bed inclined upwards from the bottom portion thereof to the top portion thereof, and drive means for shuffling material downward from the top portion to the bottom portion of the bed. A first material feed system transports the high moisture content material from the source to the top portion of the bed, and includes a surge bin disposed between the source and the dryer for assuring a constant supply of material to the dryer for constant operation. There are means for detecting the amount of material delivered to the dryer; and a controller, responsive to the means for detecting, including means for adjusting the rate material is processed through the dryer.

The dryer drive means comprises a set of fixed slats and a set of slidable slats disposed longitudinally from the top portion of the bed to the bottom portion of the bed.

The slidable slats are connected to a series of spaced horizontally running shuffle slat supports and the shuffle slat supports are connected to at least one shuffle slat support tie bar running longitudinally from the top portion of the bed to the bottom portion of the bed. The drive means further includes means for driving the shuffle slat support tie bar longitudinally back and forth. The drive means includes a motor connected to a drive shaft and means attached to the drive shaft, for converting rotating motion to linear motion. At least one tie rod is connected on one end to the means for converting and attached on the other end to the shuffle slat support tie bar. The tie rod is connected to the shuffle slat support tie bar via the upper most shuffle slat support.

The motor then is connected to the controller and the means for adjusting the rate of material processed through the dryer includes means for operating the motor for different periods of time. The means for detecting includes means for sensing when the top portion of the bed contains sufficient material to be dried and also means for sensing the amount of material in the surge bin.

DISCLOSURE OF PREFERRED EMBODIMENT

Other objects, features and advantages will occur to those skilled in the art from the following description of a preferred embodiment and the accompanying drawings, in which.

Figure 5:
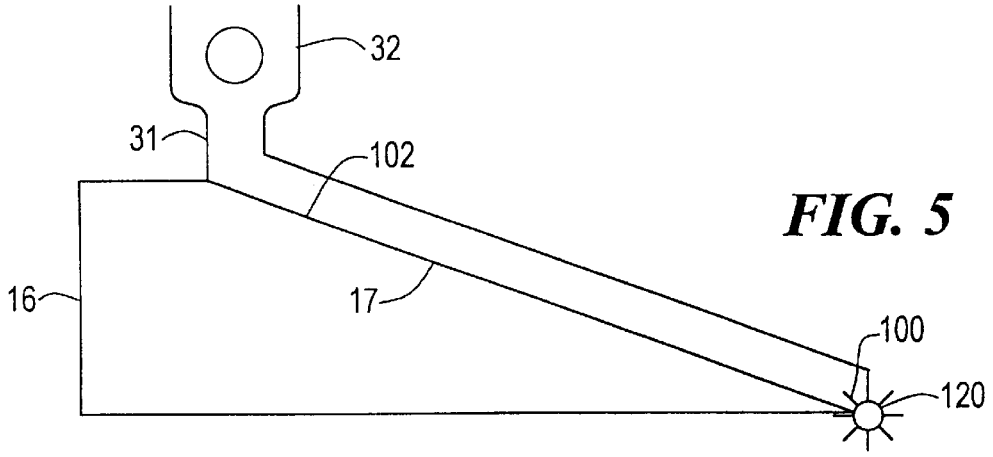
FIG. 5 is a schematic view of the mechanism for delivery of material to the top of the dryer bed shown in FIG. 1.
Figure 8:
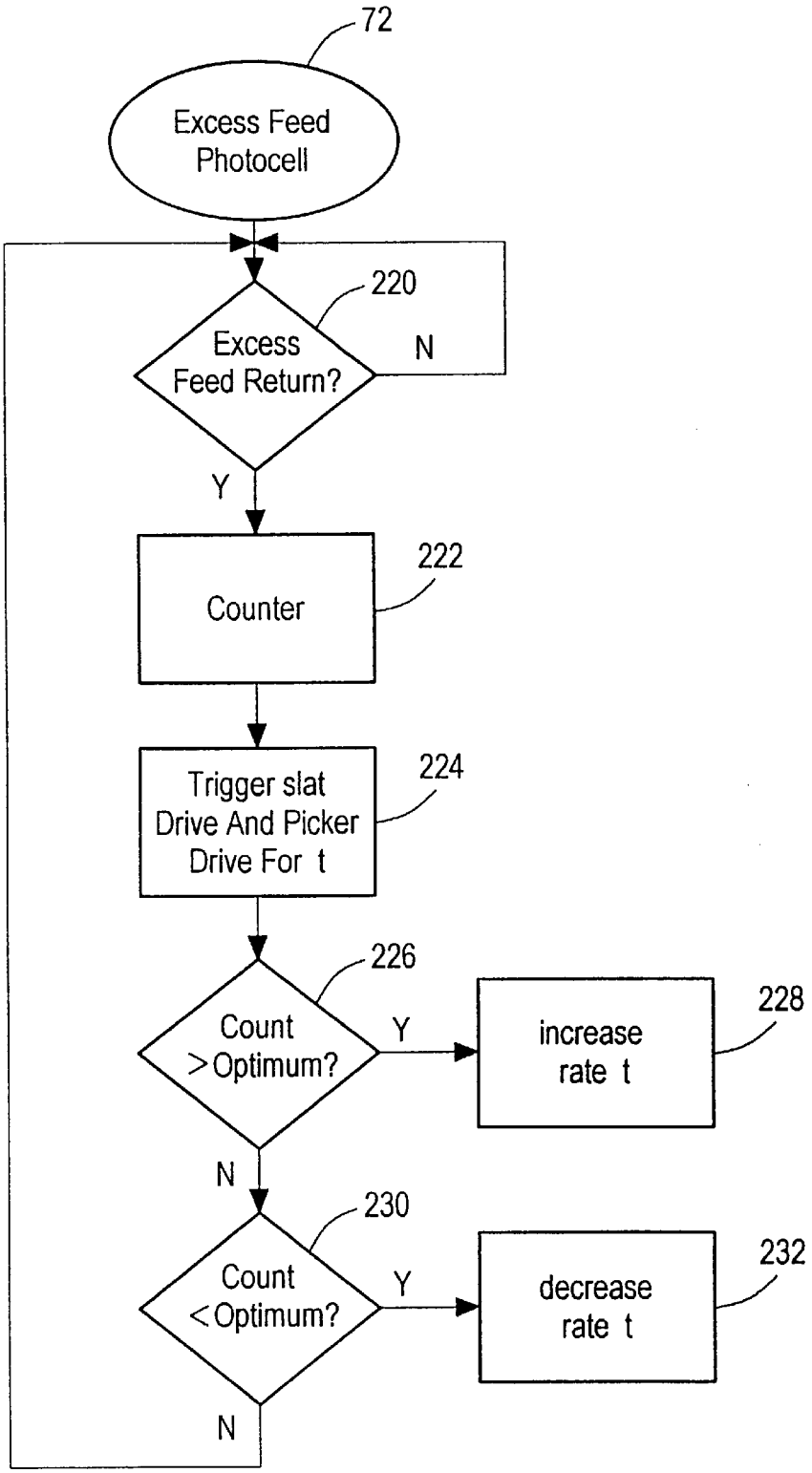
Figure 9:
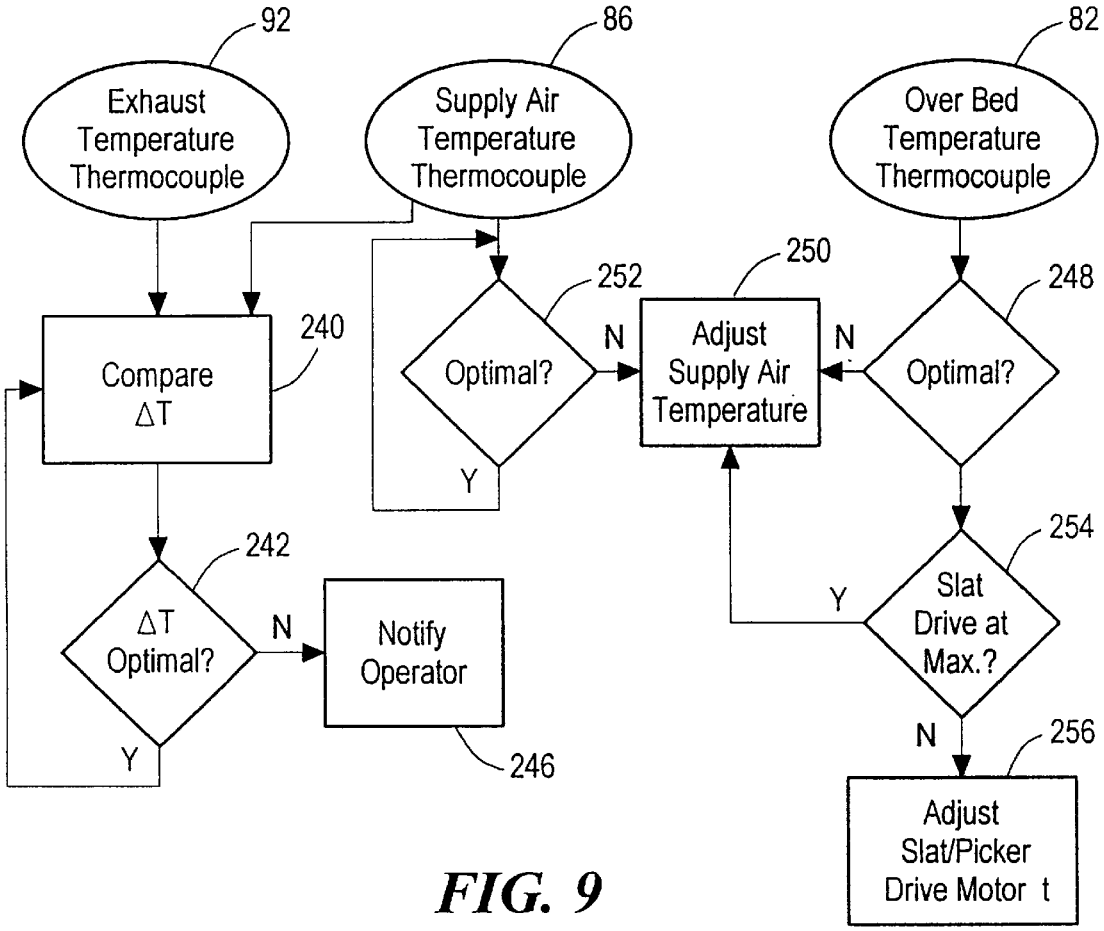
Figure 10:
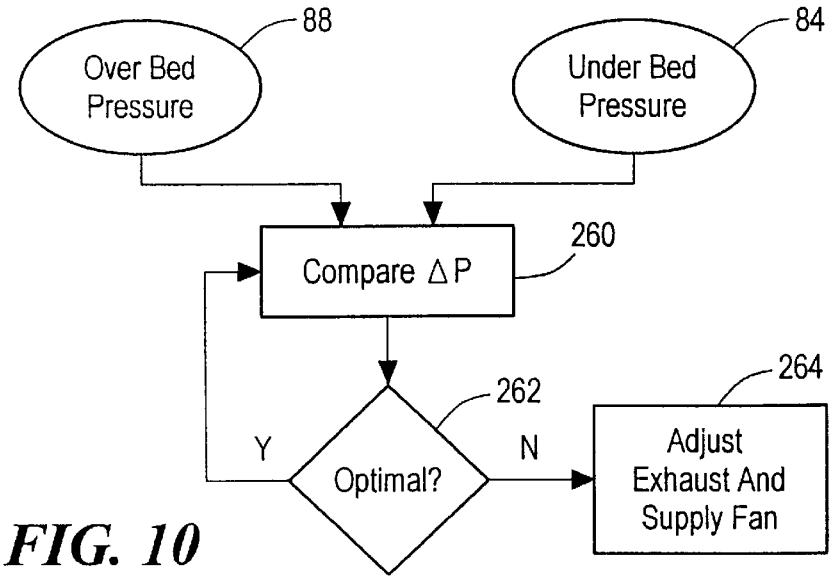

FIG. 8 is a flow chart diagram showing the programming and operation of the system controller shown in FIG. 5 for increasing and decreasing the dryer processing rate; and FIGS. 9 and 10 are flow chart diagrams depicting the programming and operation of the system controller shown in FIG. 5 for optimizing supply air temperatures and pressures within the dryer subsystem in accordance with this invention.

Figure 1:
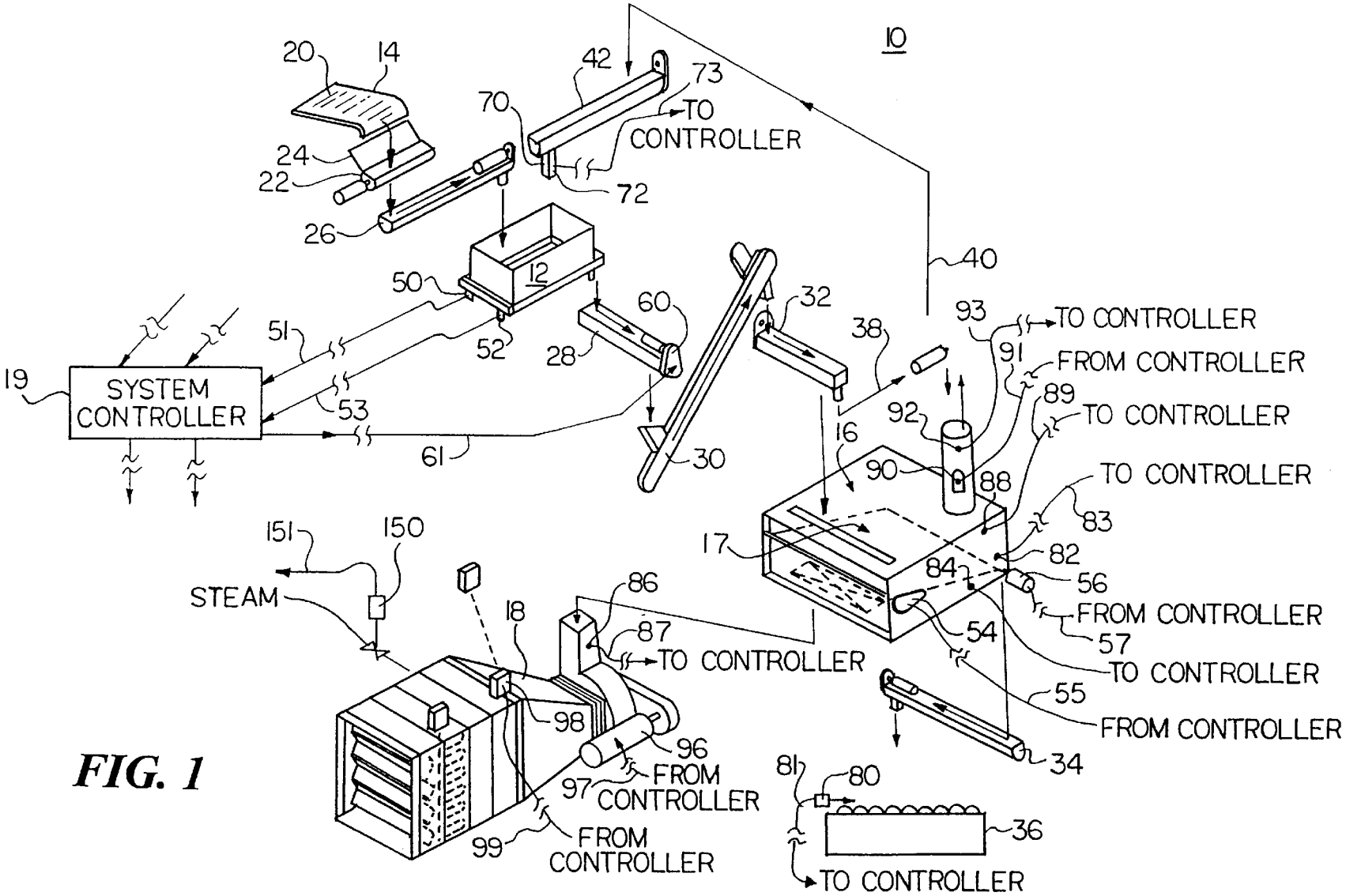
FIG. 1 is a schematic view of one embodiment of the automatic system for drying high moisture content material of this invention.

System 10, FIG. 1, of this invention uniquely features surge bin 12 disposed and acting as a buffer between a source 14 of high moisture content material and dryer subsystem 16. Surge bin 12 assures a constant supply of feed material to dryer 16 thereby assuring constant operation of the dryer and forced hot air generator subsystem 18 associated with dryer 16 to dry high moisture content material.

High moisture content material 20 is often in the form of a thin sheet like material after passing through an Ashbrook-Simon-Hartley (Houston, Tex.) belt or screw press (not shown). High moisture content material 20 comprises approximately 70% moisture which, at the present time, is normally taken to a disposal site in that form. After processing by system 10 in accordance with this invention, however, high moisture content material 20 is dried to the point where it contains less than 15% moisture.

Since landfills charge by the pound, if 2,000 pounds of 70% moisture content sludge can be dried to 15% moisture content, approximately 1,300 pounds of moisture is removed from material which reduces the cost of disposal by 65%. Remarkably, the material, when dried to a 15% moisture content level, can be utilized as a fuel for power generation. And, the dried material can even be used as a furnish in a paper processing operation for manufacturing lower quality paper.

System 10 operates as follows. Former 22 receives the pressed sludge sheet material 20 and grinds it to a flat particles about 1–2" in diameter. Bypass gate 24 can be placed in two positions: a first position wherein press sludge sheet material 20 is delivered to former 22, and a second position wherein press sludge sheet material 20 is delivered to a truck or other disposal bin for direct disposal upon the occurrence of operating problems with system 10.

Former 22 is a custom fabricated device consisting of an inlet hopper which directs material 20 onto a rotating shaft fitted with carbide tipped rotating tines which break up the sheet material and force it through a perforated screen, the diameter and arrangement of the perforations determining the size of the particle discharged from the former, generally from ¾ to 2" diameter particles of similar thickness to the thickness of sheet material 20. Screw type feed conveyor 26 transports these particles to surge bin 12. Surge bin 12 contains a live, or self unloading bottom consisting of screw or belt conveyor components to accomplish discharge from the bin, which when operated, transfer the material to cross conveyor 28 for delivery to elevator 30. Elevator 30 delivers the material to leveler conveyor 32 which, in turn, delivers the material to the top portion of inclined bed 17 of dryer 16. After the material is dried in dryer 16, it passes from the bottom portion of bed 17 to discharge conveyor 34 which transports the dried material to tractor trailer truck bed 36 or other disposal sites for subsequent burning, disposal, or reprocessing.

Any excess material delivered to the top portion of dryer bed 17 continues on through the end of leveler conveyor 32 to another set of conveyors (not shown for clarity but represented by arrows 38 and 40) to excess feed conveyor 42 which delivers the excess material back to surge bin 12.

As discussed above, surge bin 12 acts as a buffer between dryer 16 and for example, the sludge output of a paper mill operating 24 hours a day but producing different qualities and different quantities of sludge at any given time which requires adjustments to the dryer feed delivery and dryer processing rates. Unique to this invention are means for detecting the amount of material delivered to the surge bin, and a controller 19, (described in more detail below) which is capable of adjusting the rate material is transferred from the surge bin to the dryer. For example, surge bin 12 includes load cells 50, 52, etc. which provide signals on lines 51 and 53 to the controller 19 indicative of the amount of material in surge bin 12 at any given time. In response to the amount of material calculated to be in surge bin 12, controller 19 increases the speed and/or periodicity of operation of drive motors 54 and 56 of dryer 16 to increase or decrease the processing time of material passing through dryer 16 depending on the amount of material available for drying in surge bin 12. In addition, the speed and/or periodicity of operation of the live bottom discharge means of bin 12 can be can be increased or decreased by the controller in response to the processing rate of dryer 16 and/or the amount of material within surge bin 12 shown, by way of example, by the connection 49 between controller 19 and motors 48 of the live bottom transport of bin 12.

The result is a dryer with a variable processing rate in proportion to the output from the papermill, thereby assuring continuous output of dried material of consistent quality from dryer 16. Without surge bin 12, there will be times when bed 17 of dryer 16 would be overloaded resulting in inefficient drying of the material delivered to it, and times when dryer 16 would be at least partially empty resulting in a waste of energy. If bed 17 of drier 16 is not completely full, hot air escapes through the empty areas instead of through the material to be dried resulting in inefficient operation of the system and unacceptable variations in the dryness of the discharged product.

Therefore, another unique feature of this invention is the ability to detect when the top portion of bed 17 of dryer 16 is full. When the top portion of bed 17 is full, material in leveler conveyor 32 is delivered via feed lines 38 and 40 to excess feed screw-type conveyor 42 and back to surge bin 12 through feed chute 70. One or more photocells 72 disposed in feed chute 70 detect when excess feed is being delivered to surge bin 12 and provides a signal over line 73 to system controller 19. System controller 19 then operates dryer drive motors 54 and 56 to urge material downward from the top portion of bed 17 to the bottom portion of the bed thereby making room for additional material to be processed at the top portion of the bed and material delivered from leveler conveyor 32 will now again begin to fill the top portion of bed 17 resulting in a lack of any excess material delivered over lines 38 and 40 until top portion of the bed is filled and the process begins once again.

The other process controls sensors unique to system 10 are disposal capacity photocell 80 which tells the controller 19 that the disposal bin 36 has reached its capacity so that the controller can trigger an idle condition or an orderly shut-down of system 10. Controller 19 also uses the information from thermocouple 82 disposed over bed 17 of dryer 16, supply air thermocouple 86 which detects the temperature of the hot air supplied to dryer 16, and exhaust thermocouple 92 which detects the temperature of the air exiting heater 16 to optimize the efficiency of the system. The controller will vary the supply air temperature to dryer 16 depending on the process rate of the system and/or the input from other system sensors. The supply air temperature can be varied by operating the bypass damper in hot air system 18, by modulating the steam flow to hot air system 18, or other common means utilized to obtain air flow to a process at a desired temperature. Finally, pressure transducer 84 located under bed 17 of dryer 16 and pressure transducer 88 located over bed 17 of drier 16 are used by controller 19 to adjust supply air fan 96 and/or exhaust fan 90. The description of the system controller is also described below with respect to FIGS. 5–9.

Figure 2:
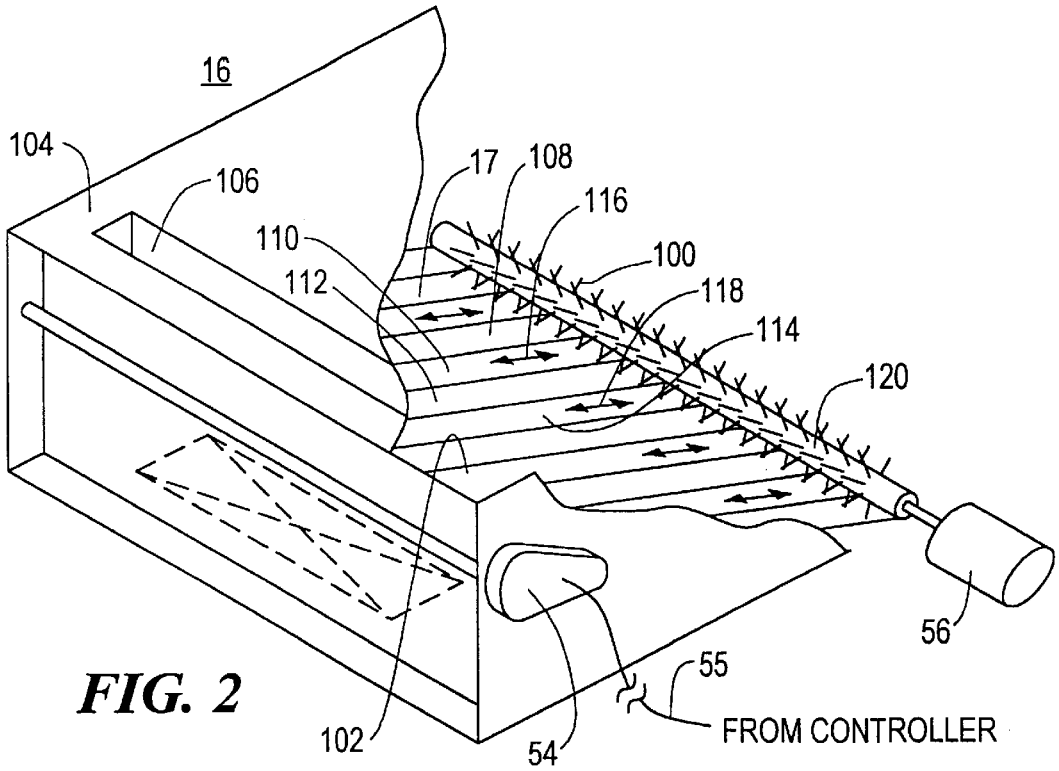
FIG. 2 is a schematic view of the dryer subsystem of the automatic system shown in FIG. 1.

Specially fabricated dryer 16, FIG. 2 according to this invention includes bed 17 inclined upwards from the bottom portion 100 to the top portion 102 of the dryer where the high moisture content material is received for drying through slot 106 in housing 104. Slot 106 is positioned to receive material from leveler conveyor 32, FIG. 1, as depicted in FIG. 2. Bed 17 of dryer 16 includes a series of slats 108, 110, 112, 114, etc., FIG. 2, disposed longitudinally along the length of bed 17. Alternate slats, such as slats 110 and 114 are slidable in the direction shown by arrows 116 and 118 under the operation of slat drive motor 54 while the adjacent slats, such as slats 108 and 112 are fixed to the dryer frame. Slat drive motor 54, when operated by system controller 19, FIG. 1, drives the slidable slats back and forth as shown by arrows 116 and 118 to urge material downward over bed 17. Picker motor 56, connected to picker mechanism 120, when operated, causes the discharge of material from the bottom portion 100 of bed 17 to discharge conveyor 34, FIG. 1. Slat drive motor 54, FIG. 2, is a constant speed motor and picker motor 56, FIG. 2, is of the fixed or variable speed type, both of which are operated by the system controller 19, FIG. 1, for variable amounts of time. For example, if slat drive motor 54, FIG. 2 is operated for 6 seconds, slidable slats 110 and 114 shuffle or reciprocate back and forth in the direction shown by arrows 116 and 118 approximately 1½ times. If slat drive motor 54 is operated for 10 seconds, the slidable slats reciprocate back and forth the approximately 3 times. Picker drive motor 56 operates normally at two revolutions per minutes and if operated by the controller for 17 seconds results in about a ⅓ rotation of picker mechanism 120, while operation of picker drive motor 56 for 29 seconds results in about a ½ rotation of picker drive mechanism 120. The speed of motor 56 can be varied by the controller to effect the density of the material in bed 17 such that optimum air flow characteristics, i.e. static pressure and temperature can be maintained within dryer 16. A typical dryer unit 16 is approximately 8 feet high, 10–12 feet wide, and 13 feet deep and bed 17, whose inclination is dependent on the natural angle of repose of the material being dried, is in the range of 30 to 45° from the horizontal. A typical system consist of one or more such dryer units, and the capacity of the system is increased by increasing the number of dryer units.

Figure 3:
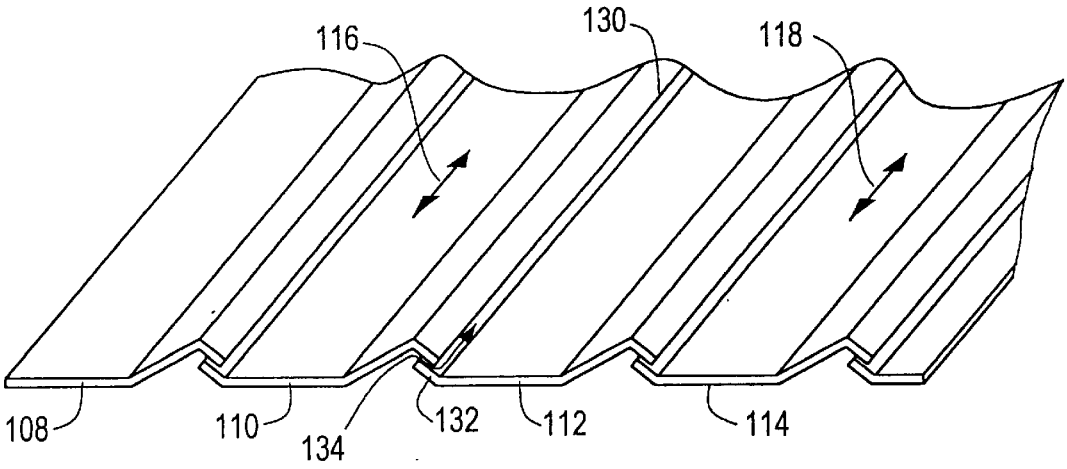
FIG. 3 is a schematic view of the slats which make up the bed of the dryer subsystem shown in FIG. 2.

Slats 108, 110, 112, and 114 are shown in more detail in FIG. 3. Each slat, such as slat 110 includes a raised canopy portion 130 on one side and, as shown for slat 112, a raised leaf 132 on the opposing side to define an air gap between adjacent slats 110 and 112 as shown by arrow 134 so that heated air can pass from underneath the bed of the dryer and through the slats to dry the material on the slats. Canopy portion 130 prevents the particulate material on the slats from falling between the slats and contaminating the dryer.

Figure 4:
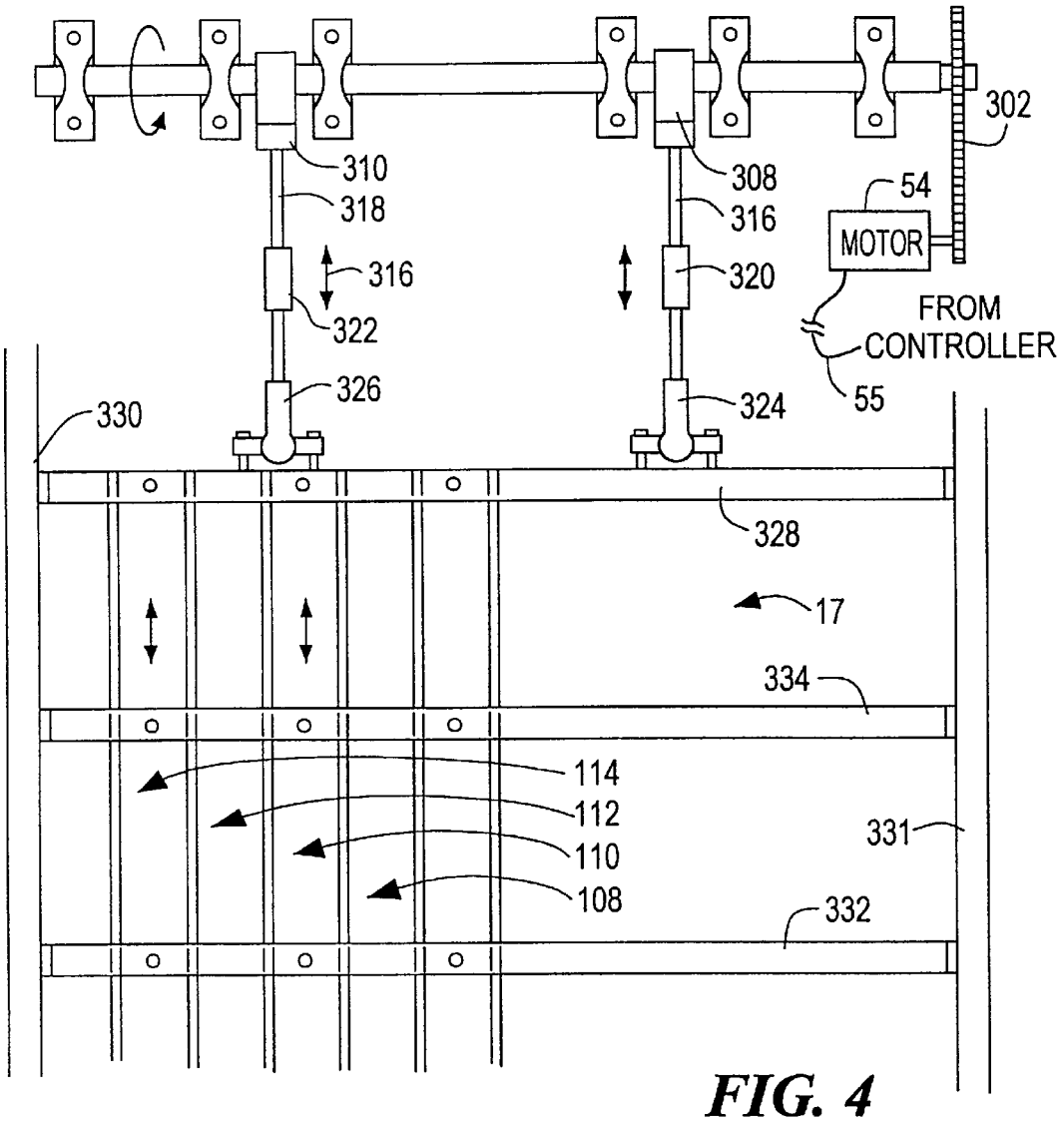
FIG. 4 is a schematic view of the slat drive mechanism for the dryer subsystem shown in FIG. 2.

The operation of slat drive motor 54, FIG. 2 and longitudinally slidable slats 110 and 114, FIG. 3 is shown in FIGS. 4–5. Slat drive motor 54 is connected to drive shaft 300 via chain drive 302. Drive shaft 300 is connected to the top of the dryer through bearings 304, 306, etc. Two cam and drive blocks 308, 310 are coupled to drive shaft 300 and transfer the rotary motion of drive shaft 300 into a reciprocating motion as indicated by arrows 312 and 314, respectively. Cam and drive blocks 308 and 310 drive tie rods 316 and 318, respectively, which include couplings 320 and 322 connected to tie rod end bearings 324 and 326. The end bearings are connected to the upper most horizontal shuffle slat support 328 which in turn is connected to longitudinal shuffle slat support tie bars 330 and 331 on each end. Each shuffle slat support 328, 333, etc is connected to the shuffle slat support tie bars 330 and 331 while alternating fixed slat supports 334, etc. are affixed to the frame of the dryer. The slidable slats 110, and 114 are bolted to the shuffle slat supports 328 and 332 and the fixed slats are bolted to the fixed slat supports as shown. When slat drive motor 54 receives a signal from controller 19, FIG. 1, it begins to operate and tie rods 316 and 318 drives top most shuffle slat support 328 back and forth which, through shuffle slat support tie bars 330 and 331, also drives the other shuffle slat supports (e.g. support 332) back and forth thereby moving the slidable slats 110 and 114 back and forth as shown.

In this way, as material is fed via leveller conveyor 32, FIGS. 1 and 5 to the top portion 102 of dryer bed 17 through chute 31 in slot 106, FIG. 2, in dryer 16, FIG. 5, is urged downward towards the bottom 100 of dryer bed to be discharged therefrom by picker mechanism 120.

Unique to this invention is the ability of the controller to run slat drive motor 54 for different periods of time depending on the amount of material available to be processed and/or the temperature of the heated air available for drying as described in more detail below. Also unique to this invention is the ability of the controller to operate the slat drive motor only when there is sufficient material present along the length of top portion 102 of the dryer bed, FIG. 5, for drying.

Figure 6:
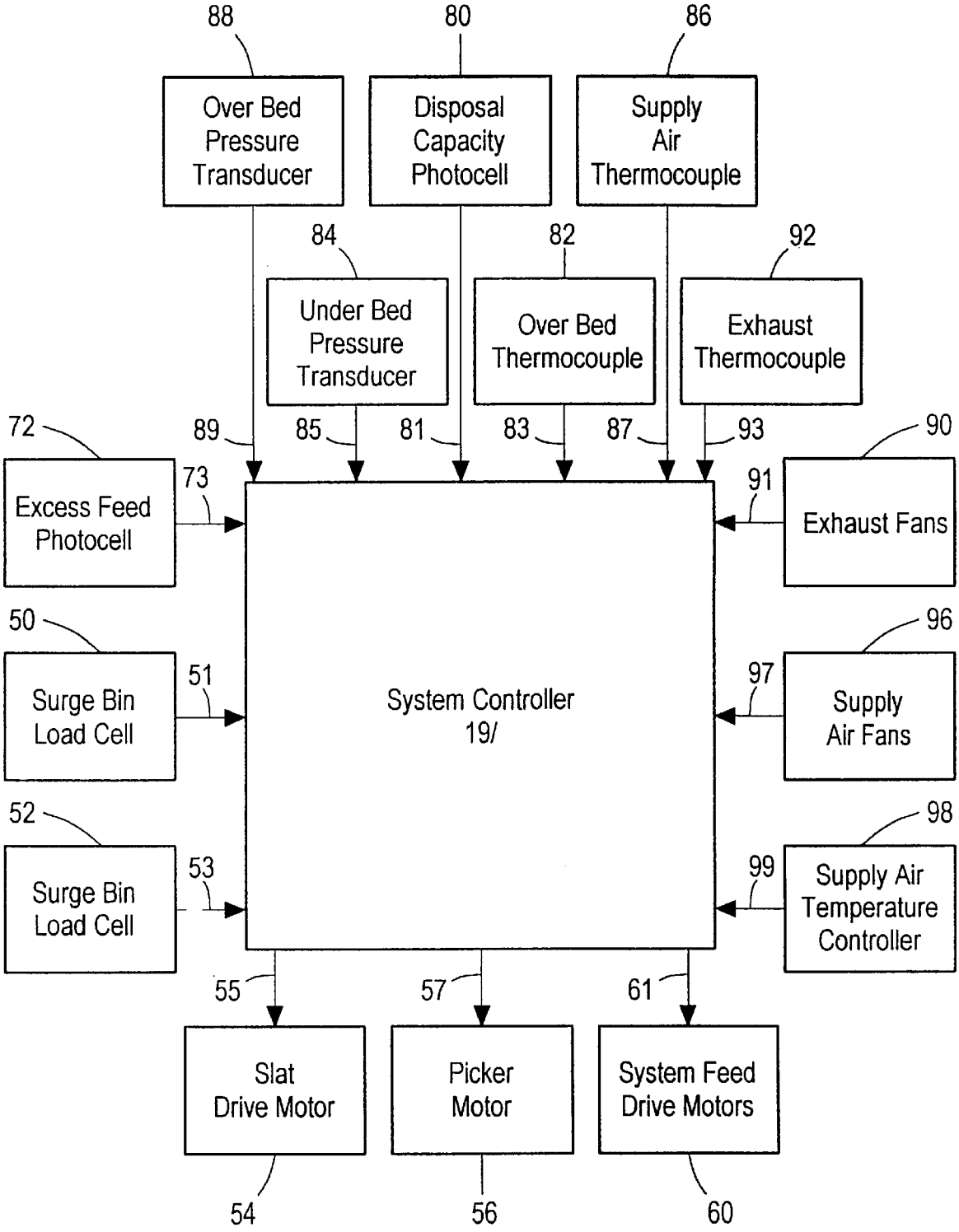
FIG. 6 is a block diagram of the system controller for the automatic drying system shown in FIG. 1.
Figure 7:
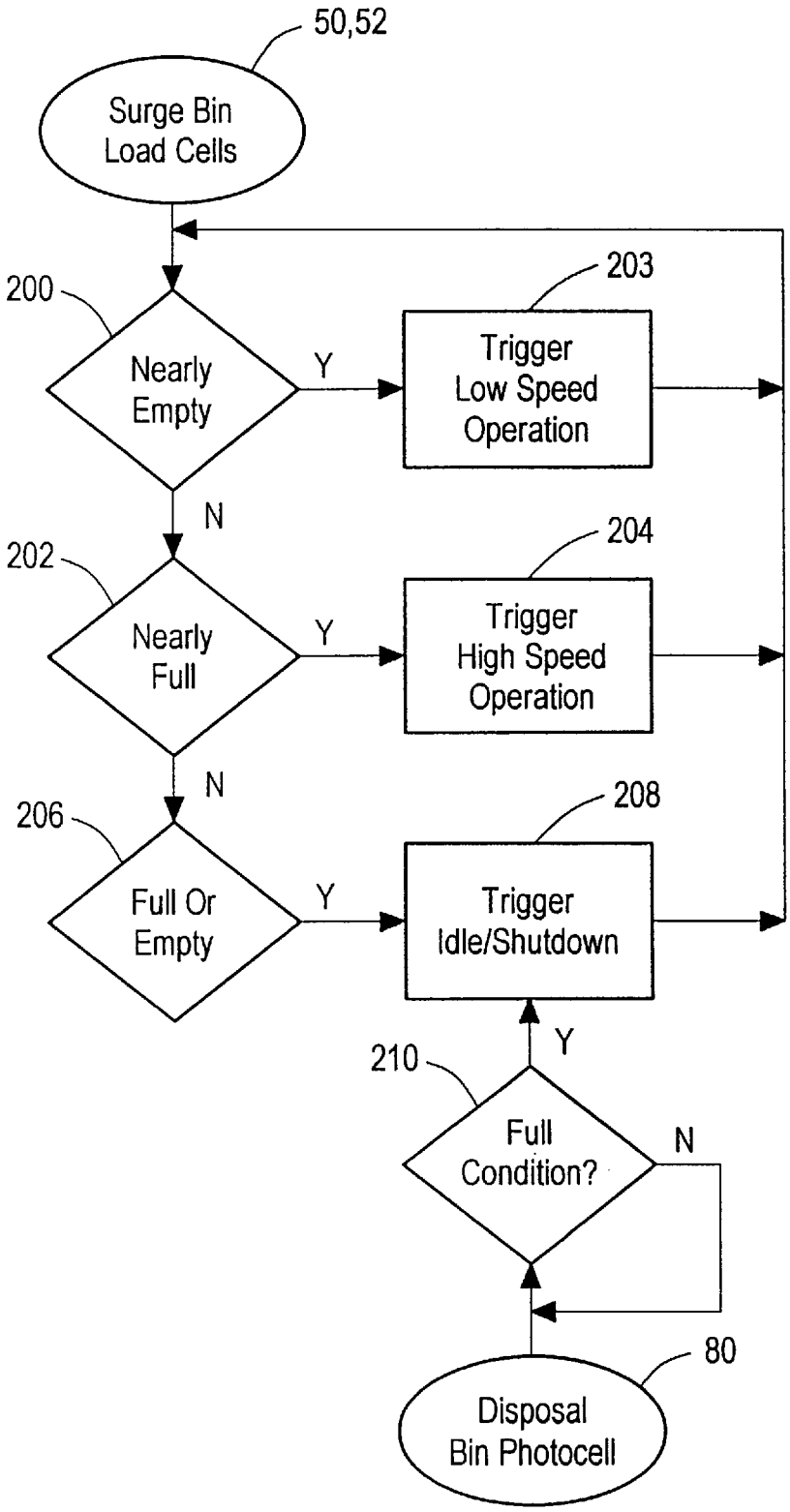
FIG. 7 is a flow chart diagram showing the programming and operation of the system controller shown in FIG. 5 for operating the system at high and low speeds.

System controller 19, FIG. 1 which may be an Allen-Bradly SLC500 programmable logic controller is shown in more detail in FIG. 6. The labeling in FIG. 5 corresponds to the labeling in FIG. 1 but of course there may be other inputs and other outputs to and from system controller 19 depending on the specific implementation. Excess feed photocell 72 provides a signal to system controller 19 over line 73 to determine whether the top portion of the heater bed contains enough material to be dried. System controller 19 then provides signals to slat drive motor 54 and picker motor 56 over lines 55 and 57, respectively, to initiate the operation of the slat drive and picker motors. In a preferred embodiment, the slat drive and picker motors are only operated when a signal is received from excess feed photocell 72 indicating that top of the heater bed is now full. Otherwise, a portion of the top of the heater bed may be left open, and, since it does not contain any material to be dried, the hot air from underneath the bed will be wasted since it will then pass through the empty portion of the bed. When this happens, the hot air will not adequately dry the material on the bed. For drying efficiency and energy conservation, it is very important that the heater bed contain material to be dried at all times and in all areas of the bed. Otherwise, the hot air will find a path of least resistance, namely, in the area of the bed which does not contain material to be dried.

System controller 19 also receives input from surge bin load cells 50 and 52 over lines 51 and 53, respectively, and determines the amount of source material within the surge bin at any given time. In the event that the surge bin contains enough material to begin processing at high speed operations, system controller 19 triggers the surge bin 12 live bottom to operate at high speed by increasing the speed or periodicity of motor 48 thereby supplying more material to the dryer at high speed operation, controller 19 also operates slat drive motor 54 and picker motor 56 for longer periods of time each time they are turned on to increase the rate of material processing. When surge bin load cells 50 and 52 indicate that low speed operation is appropriate, system controller 19 triggers the surge bin 12 live bottom to operate at lower speeds or reduced periodicity and also operates slat drive motor 54 and picker motor 56 for shorter periods of time each time they are turned on. As explained above, slat drive motor 54 and picker motor 56 are only operated when excess feed photocell 72 indicates the top portion of the dryer bed is full.

A signal from disposal capacity photocell 80 over line 81 to system controller 19 indicates when the disposal capacity has reached a maximum and system controller 19 may then initiate an idle condition or an orderly shut down of the system. In an idle condition feed to dryer is stopped and the supply air temperature is reduced to approximately 200° F. If discharge capacity is restored, i.e. an empty container is placed under the discharge, the system temperature is returned to the set point, feed resumes to dryer and operation continues. If the full discharge container is not replaced within a certain time period, the level in bin 12 will increase to the high limit, causing an orderly shutdown. In an orderly shutdown the feed to the dryer is stopped, the feed to former is stopped, and the steam supply to heater 18 is brought to a minimum setting (approximately 10% open for freeze protection) by closing the modulating valve 150 via line 151. The fans run until the supply air temperature reaches 150° F. (cool down) and then shut down. Once the fans are off, the outside air damper to heater 18 closes.

System controller 19 also monitors the pressure over the dryer bed from pressure transducer 88 via line 89 and the system pressure under the dryer bed from pressure transducer 84 via line 85 and compares the two to determine whether the optimum pressure differential is being maintained. If the optimum pressure differential is not reached, system controller 19 can adjust exhaust fan 90 by providing a signal to it over line 91 and/or supply air fan 96 by supplying a signal to it over line 97. The optimal air velocity through the dryer bed of the system shown in FIG. 1 is approximately 100 feet per minute. If the optimal air flow is not attained, the supply and/or exhaust fans can be adjusted until the resulting pressure differential across the dryer bed indicates a proper air flow. Care must be taken to maintain the system static pressure and velocity through the bed within their operating range (1½" to 3" water column static pressure, 100–200 fpm velocity). If the static pressure is excessive, the bed will fluidize, decreasing dryer performance. In case of excessive velocity or fluidization of the bed, particulate matter will be entrained in the exhaust, creating potential air quality problems.

Over bed, supply air, and exhaust thermocouple, 82, 86 and 92 are connected to system controller 19 via lines 83, 87, and 93, respectively. A correlation exists between the over bed temperature and the dryness of the discharged product. Once an over bed temperature is established for a given dryness of discharged product, over bed temperatures higher or lower than the reference indicate greater or lessor dryness of the discharged product. System controller 19 is programmed to receive input from the bed temperature thermocouple and adjust system throughput, via the slat drive and picker motor speeds and/or periodicity, to maintain the over bed temperature and therefore the dryness of the discharged material within a desired range. In the event the slat drive and picker motors are set by the controller at their maximum and the over bed temperature continues to rise, controller 19 will begin lowering the supply air temperature via the steam modulating control valve 150 via line 151 to conserve energy. System controller 19 is programmed to compare the temperature difference between the supply temperature differential and the exhaust temperature at the dryer with an optimal temperature differential and to signal the operator when the resulting temperature difference is not within a stored tolerance range. In the system shown in FIG. 1, the supply air temperatures is 300° F. and a typical exhaust the temperature is 140° F. The supply air temperature can also be compared to the over bed temperature and the supply air temperature can either be adjusted or, if the over bed temperature is not optimal, controller 19 first checks to make sure the slat drive and picker motors are set at their maximum rate and adjusted accordingly so that excess energy is not wasted. If the overbed temperature is below an optimum pre-set level, controller 19 stops the operation of the material feed drive motors and the picker and slat drive motors until the optimum over-bed temperature is reached.

System controller 19 is programmed in accordance with the block diagram shown in FIGS. 7–10. If the signal from surge bin load cells 50, 52, FIG. 6 indicate that the surge bin is nearly empty, step 200, FIG. 7, controller 19 triggers low speed operation, step 203, of the system material feed drive motors 60 which, as explained above, actually comprise all the conveyor and elevator motors operated either independently or synchronously. If the surge bin load cells indicate that the surge bin is nearly full, step 202, system controller 19 triggers high speed operations of the material feed motors, step 204. If the surge bin load cells indicate that the surge bin is over full or completely empty, step 206, system controller 19 either sets an idle or shut down condition, step 208. "Nearly empty", as used above means a surge bin which is approximately 25 percent full; "nearly full" means the surge bin which is approximately 75 percent full, "full" means 90 percent full, and "empty" means 0 percent full. Also, if a full disposal bin condition is reached, step 210, based on a signal from the disposal bin photocell, system controller 19 also triggers the operation of an idle and/or shut down condition. Surge bin 12 is designed to hold approximately a one hour supply of raw material for a system which processes one ton of material per hour, such a surge bin is approximately 4' wide, 4' high and 10' long.

In this way, system controller 19 in conjunction with the unique surge bin of this invention assures the constant operation of the dryer and the hot air generation system in the most efficient manner possible. In low speed operation, controller 19 also establishes a speed and/or periodicity for the slat and picker motor drives which is field determined and provides a center point of a range in which the controller or operator can vary the slat and picker drives to maximize the performance of the dryer. Similarly, in high speed the controller establishes a center point of the operating range of the slat and picker drive for the higher feed rate to the dryer. In the system described above, low speed operation means that the motors of the various feed conveyors and elevators are being operated to deliver approximately 1–2,200 pounds per hour from the surge bin to the dryer. Low speed operation also means that the slat drive motor is operated for only six seconds resulting in 1½ reciprocating motions of the longitudinally slidable slats and that the picker drive motor is operated for 17 seconds resulting in ⅓ of a rotation of the picker mechanism. High speed operation means that controller 19 operates the feed conveyors and elevators at a rate which delivers 2100 pounds per hour from the surge bin to the dryer and the slat drive motors is operated for 10 seconds each time it is turned on resulting in 3 reciprocating motions of the slidable slats, while the picker drive motor is operated for 29 seconds each time that it is turned on resulting in about a ½ rotation of the picker mechanism. Typically the operating times are determined in the field during system start up and calibration, and vary somewhat from installation to installation.

As discussed above, it is essential that each area of the bed contain sufficient material to be dried lest the hot air delivered to the under side of the bed escape through open areas of the bed. The signal from the excess feed photocell 72, FIG. 8, determines when excess feed is being returned to the surge bin, step 220, and then initiates timer 222. Each time excess feed is returned to the surge bin, the slat drive motor and picker drive motors are operated for a preset period of time (t), step 224. As discussed above, the slat drive motor and picker drive motor are operated only when excess feed is returned to the surge bin thereby assuring that the top portion of the dryer bed contains enough material to be dried and that there are no open areas or gaps through which hot air can escape.

If, however, regardless of the material feed rate, it is determined by controller 19 that the time between successive full conditions at the top portion of the heater bed is shorter or longer than an optimum value, controller 19 can increase or decrease the time period which the drive and picker motors remain on thereby increasing or decreasing the flow rate through the dryer. Timer 222 is activated each time the photo cells detect excess flow to the surge bin. The timer is reset on each cycle. The accumulated value is compared with an optimum value by controller 19. As the speed of the surge bin discharge and dryer feed conveying means are fixed at low and high speeds, variation in the accumulated value of timer 222 indicates the density or other handling characteristic of the raw material has changed. As the dryer capacity for evaporation is based on the weight of water evaporated, and the amount of product in the dryer at any one time is a fixed volume, density changes in the feed material will effect dryer performance. If the density of the feed material is decreased, all other operating parameters held constant, the dryer will tend to over dry the feed material. Conversely, if the density of the feed material increases, the dryness of the discharged product generally decreases. In order to overcome this type of variation in the dryness of the discharged product, the system controller will adjust the dryer throughput rate based on the density of the feed material as determined by the variance of the accumulated value of timer 222. If the accumulated value is less than optimum the controller, provided the above bed temperature is within an acceptable range, will increase slat and picker drive speed and/or periodicity increasing dryer throughput. Similarly, if the accumulated value is greater than the optimum, dryer throughput is reduced accordingly. In operating in this manner, the dryer can adjust to variances in the physical properties of the sludge, primarily density, by making small adjustments to average throughput rate determined for each operating speed.

Timer 222 is initiated each time excess feed is returned to the surge bin and controller 19 then compares that count with an optimum time period. If the count is greater than the optimum, step 226, the time period (t) in which the drive and picker motors remain on is increased, step 228. If the count is less than the optimum figure, step 230, the time (t) that the drive and picker motors remain on is decreased, step 232. The slat drive motor may remain on for either 6 or 10 seconds and the picker drive motor may remain on for either 17 or 29 seconds depending on whether the system is in high or low speed operation. In other embodiments, the slat drive motor and picker drive motor may have variable speeds and the controller, responsive to the counter, may increase or decrease the motor speed as required. The feed rate of the motors, then, is a function of the time they remain on for fixed speed motors and a function of the speed of the motors and the time they remain on for variable speed motors. Regardless of whether the material feed system itself is in high or low speed operation, however, the time in which the drive and picker motors remain on can be decreased or increased independently to optimize the system efficiency thereby assuring a consistent quality of dried product and minimal excess feed to the surge bin.

In operation, a minimal amount of excess is returned to the surge bin. If excess is returned in large amounts or continuously to the surge bin, the surge bin itself begins to degrade the size of the excess feed material and it becomes too small to be dried efficiently in the dryer subsystem. As a particle size degrades, the dryer bed can become so tightly packed with material that it cannot efficiently dry the material. In this invention, this problem is overcome by first urging material downward over the dryer bed only when there is enough material to fill the bed and, second, operating the slat drive and picker drive motors at variable rates which assures that little excess is ever returned to the surge bin. The optimum drying conditions occur when particles of material approximately 1–2" in diameter fully cover the bed to a depth of approximately 4–6 inches. A series of spaced rods extending the length of the bed and fixed over the bed as shown in the '885 patent assist in keeping the particles flowing downward over the bed during drying.

The system controller also programmed with a number of other capabilities, a few of which are shown in FIGS. 9 and 10. The optimum exhaust temperature in the system shown in FIG. 1 is 140° F. Exhaust temperature thermocouple 92, FIG. 9 tells controller 19 what the actual exhaust temperature is and compares it to the supply air temperature thermocouple reading from supply air temperature thermocouple 86 which is optimately 300° F. If the calculated temperature differential, step 240, is not close to the optimal temperature differential (160° F.), this could indicate a situation where the bed of the dryer is overpacked, or contains open areas through which hot air is escaping. If the comparison reveals that the temperature differential is not optimized, the operator can be notified, step 246, for example by a warning light on the system controller. If thermocouple 82, positioned over the bed of the dryer, indicates that the temperature is above or below an optimal temperature, step 248, controller 19 and can also adjust the supply air temperature, step 250 in the same manner that the supply air temperature thermocouple reading 86 can be used to determine an optimal supply air temperature, step 252.

If the overbed thermocouple indicates a temperature which is too high, however, a check is first made, step 254, to determine if the slat drive and picker drive motors are being operated for their maximum amount of time each time they are turned on. If not, this is a condition indicative of a waste of energy since not enough material is being processed for the temperature of the supply air being delivered to the dryer. Accordingly, if this condition occurs, the time (t) in which slat drive and picker motors remain on can be adjusted, step 256, until the optimal over bed temperature is reached. This results in an energy savings since the hot air generation system does not then have to be adjusted up or down allowing it to be run at a constant supply air temperature which is checked by supply air temperature thermocouple 86.

As explained above, it is preferable that approximately 100 feet per minute of 300° F. air passes through the bed of the dryer. The readings from over bed pressure transducer 88 and under bed pressure transducer 84, FIG. 10 are compared by the controller in step 260 and also compared with an optimal stored differential pressure resulting in an air flow of approximately 100 feet per minute, step 262, and the exhaust and/or supply air fans can be adjusted accordingly, step 264 until the optimal value is reached. It should be noted that increasing the exhaust fan to too high a level can result in material being discharged through the exhaust and therefore there are times when the exhaust fan motor is set at a maximum rate and then the supply air fan must be increased.

The result is an efficient, continuously operable, and automatic system for drying high moisture content material. Surge bin 12, FIG. 1 is placed between the sludge output of a paper mill and the input of dryer 16 which dries the sludge. The mechanical drive subsystem of the dryer urges the sludge through the dryer at variable rates, and the material feed subsystem can be operated at different feed rates. A set of sensors, (e.g. sensors 50, 52, and 72), are placed at strategic points throughout the system, and controller 19 automatically triggers the operation of dryer and the material feed systems in response to signals from the sensors indicative of different quantities and qualities of sludge to be dried.

In this way, the waste material is continuously and automatically dried independent of the quantity and quality of the sludge supplied from the paper mill eliminating wasted heat when no sludge is available for processing and overloading conditions when too much sludge is presented for processing. The dryer processing rate can also be adjusted independently of the rate of material fed to the dryer to assure the dryer bed is always sufficiently full and that the drying rate is optimized depending on the available hot air and material feedstock.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. An automatic system for drying high moisture content material from a source, the system comprising:

a dryer including a bed inclined upwards from the bottom portion thereof to the top portion thereof, and drive means for urging material downward from the top portion to the bottom portion of the bed;

a first material feed system for transporting the high moisture content material from the source to the top portion of the bed, said first material feed system including a surge bin disposed between the source and the dryer for assuring a constant supply of material to the dryer for constant operation thereof;

means for detecting the amount of material delivered to the surge bin; and a controller, responsive to the means for detecting, including means for adjusting the rate of material transferred from the surge bin to the dryer.

2. The system of claim 1 further including a second material feed system for transporting back to the surge bin any excess material delivered by the first material feed system to the top portion of the dryer.

3. The system of claim 2 in which said means for detecting includes means for sensing any excess material transferred by the second material feed system back to the surge bin.

4. The system of claim 3 in which said controller is connected to said means for sensing and said dryer drive means and the controller includes means for operating said dryer drive means when excess material is detected being delivered back to the surge bin.

5. The system of claim 4 in which said controller includes means for operating said dryer drive means only when excess material is detected as being transported back to the surge bin.

6. The system of claim 1 in which said means for detecting includes means for sensing the amount of material in the surge bin.

7. The system of claim 6 in which said first material feed system is operable at least two speeds and said controller includes means for switching between said at least two speeds in response to the amount of material in the surge bin.

8. The system of claim 1 in which said dryer bed includes a series of slats disposed longitudinally along the length of the bed, alternate slats being longitudinally slidable with respect to adjacent slats, and said drive means including means for propelling said slidable slats back and forth to shuffle material on the bed downward.

9. The system of claim 8 in which said controller includes means for operating said means for propelling for variable periods of time.

10. The system of claim 8 in which said adjacent slats overlap each other for preventing material from falling between adjacent slats.

11. The system of claim 10 in which said adjacent slats define longitudinal air gaps therebetween for passing air through material disposed on the bed.

12. The system of claim 8 in which the drive means further includes a picker mechanism disposed along the bottom portion of the bed for discharging material off the bottom portion of the bed and a motor for operating said picker mechanism.

13. The system of claim 12 in which said controller includes means for operating said picker motor for variable periods of time.

14. The system of claim 1 in which said dryer bed includes a series of slidable slats disposed longitudinally along the length of the bed and a slat drive motor for propelling said slidable slats back and forth to shuffle material on the bed downward.

15. The system of claim 14 in which said means for detecting includes means for sensing when the top portion of the bed contains sufficient material to be dried, said controller is connected to said slat drive motor and said means for sensing, said controller including means for operating said slat drive motor only when said means for sensing indicates that the top portion of the bed contains sufficient material to be dried.

16. The system of claim 14 in which said means for detecting includes means for signaling two different amounts of material in the surge bin, said controller is connected to said slat drive motor and said means for sensing, said controller including means for operating said slat drive motor for a first period of time in response to a signal indicative of a first amount of material in the surge bin and for operating said slat drive motor for a second period of time in response to a signal indicative of a second amount of material in the surge bin.

17. The system of claim 14 in which said dryer further includes a picker mechanism disposed along the bottom of the bed for discharging material off the bottom portion of the bed and a motor for operating the picker mechanism.

18. The system of claim 17 in which said means for detecting includes means for sensing when the top portion of the bed contains sufficient material to be dried, said controller is connected to the picker drive motor and the means for sensing, said controller including means for operating the picker drive motor only when said means for sensing indicates that the top portion of the bed contains sufficient material to be dried.

19. The system of claim 18 in which the means for detecting includes means for signaling two different amounts of material in the surge bin, the controller is connected to the picker drive motor and the means for sensing, the controller including means for operating the picker drive motor for a first period of time in response to a signal indicative of a first amount of material in the surge bin and for operating the picker drive motor for a second period of time in response to a signal indicative of a second amount of material in the surge bin.

20. The system of claim 1 further including at least one of: a sensor for signaling an overfilled surge bin, a sensor for signaling an empty surge bin, and a sensor for signaling an overfilled disposal site, said sensors connected to said controller, said controller further including means for stopping the operation of said first material feed system in response to a signal from any one said sensors.

21. The system of claim 14 in which said means for detecting includes means for signaling when the top portion of the dryer bed contains sufficient materials to be dried, said controller is connected to the slat drive motor and to the means for sensing, said controller including:

means for operating said slat drive motor at one feed rate in response to a signal from said means for signaling;

a timer for counting the time between successive signals from said means for signaling; and means for adjusting said feed rate in response to the counter.

22. The system of claim 21 in which said means for adjusting includes means for increasing said feed rate in response to a time count from the timer corresponding to a minimum count.

23. The system of claim 21 in which said means for adjusting includes means for decreasing said feed rate in response to a time count from the timer corresponding to a maximum count.

24. The system of claim 21 in which said dryer further includes a picker mechanism disposed along the bottom of the bed for discharging material off the bottom portion of the bed and a motor for operating said picker mechanism.

25. The system of claim 24 in which said means for detecting includes means for signaling when the top portion of the bed contains sufficient material to be dried, said controller is connected to the picker drive motor, and said means for sensing, said controller including:

means for operating the picker drive motor at a first feed rate in response to a signal from the means for signaling;

a timer for counting the time between successive signals from said means for signaling; and means for adjusting said first feed rate in response to the timer.

26. The system of claim 1 in which said bed includes a top portion and a bottom portion, said system further including a hot air generator connected to the dryer including means for supplying variable temperature hot air to the bottom surface of the bed and means for sensing the temperature of the hot air supplied to the bottom surface of the bed, said controller including means for comparing the temperature of the hot air with an optimal temperature and adjusting said means for supplying until the temperature of the hot air is approximately the same as the optimal temperature.

27. The system of claim 26 further including means for sensing the temperature of the top surface of the bed, said controller including means for comparing the temperature of the top surface of the bed with an optimal temperature, and means for adjusting the means for supplying until the temperature of the top surface of the bed is approximately the same as said optimal temperature.

28. The system of claim 27 further including means for sensing the flow rate of air through the bed, said controller including means for comparing the flow rate through the bed with an optimal flow rate and means for adjusting the flow rate until the optimal flow rate is reached.

29. An automatic system for drying high moisture content material from a source, the system comprising:

a dryer including a bed inclined upwards from the bottom portion thereof to the top portion thereof and a drive mechanism for urging material downwards from the top portion of the bed to the bottom portion of the bed at least first and second feed rates;

a surge bin containing source material to be dried;

a material feed system for transporting source material from the surge bin to the top portion of the bed at first and second speeds;

a first detector for providing signals indicative of first and second quantities of source material in the surge bin;

a second detector for providing a signal indicative of sufficient source material present at the top portion of the bed; and a system controller connected and responsive to said first and second detectors and connected to and for operating said drive mechanism and said first material feed system, said controller including:

means, responsive to a signal from said first detector indicative of said first quantity, for operating said material feed system at said first speed and for operating said drive mechanism at said first feed rate, and, responsive to a signal from said first detector indicate of said second quantity, for operating said material feed system at said second speed and for operating said drive mechanism at said second feed rate; and means, responsive to said second detector, for independently operating said drive mechanism only when said second detector provides a signal indicative of sufficient source material present at the top portion of the bed.

30. The system of claim 29 in which said controller further includes means for counting the time between operations of said drive mechanism and for varying the drive mechanism's first and second feed rates in response to a counted time differing from a preset value.

31. An automatic system for drying high moisture content material from a source, the system comprising:

a dryer including a bed inclined upwards from the bottom portion thereof to the top portion thereof and a drive mechanism for urging materials downwards from the top portion of the bed to the bottom portion of the bed at least first and second feed rates;

a surge bin containing source material to be dried;

a material feed system for transporting source material from the surge bin to the top portion of the bed;

a first detector for providing signals indicative of first and second quantities of source material in the surge bin;

a second detector for providing a signal indicative of sufficient source material present at the top portion of the bed; and a system controller connected and responsive to said first and second detectors and connected to and for operating said drive mechanism, said controller including:

means, responsive to a signal from said first detector indicative of said first quantity, for operating said drive mechanism at said first feed rate; and responsive to a signal from said first detector indicative of said second quantity, for operating said drive mechanism at said second feed rate; and means, responsive to said second detector, for operating said drive mechanism only when said second detector provides a signal indicative of sufficient source material present at the top portion of the bed.

32. The system of claim 31 further including counter means for timing the rate of signals indicative of sufficient source material, said controller further including means for varying said drive mechanism's first and second feed rates in response to said counter means.

33. The system of claim 31 further including a third detector for providing a signal indicative of the temperature of the air over the dryer bed, said controller further including means for operating said drive mechanism at said first feed rate and said second feed rate in response to the temperature of the air over the drier.

34. An automatic system for drying high moisture content material from a source, the system comprising:

a dryer including a bed inclined upwards from the bottom portion thereof to the top portion thereof;

a surge bin containing source material to be dried;

a material feed system for transporting source material from the surge bin to the top portion of the bed at first and second speeds;

a detector for providing signals indicative of first and second quantities of source material in the surge bin; and a system controller connected and responsive to said first detector and connected to and for operating said material feed system, said controller including:

means, responsive to a signal from said detector indicative of said first quantity, for operating said material feed system at said first speed and, responsive to a signal from said detector indicative of said second quantity, for operating said material feed system at said second speed.

35. An automatic system for drying high moisture content material from a source, the system comprising:

a dryer including a bed inclined upwards from the bottom portion thereof to the top portion thereof, and drive means for shuffling material downward from the top portion to the bottom portion of the bed;

a material feed system for transporting the high moisture content material from the source to the top portion of the bed, said material feed system including a surge bin disposed between the source and the dryer for assuring a constant supply of material to the dryer for constant operation thereof;

means for detecting the amount of material delivered to the dryer; and a controller, responsive to the means for detecting, including means for adjusting the rate material is processed though the dryer.

36. The system of claim 35 in which said drive means comprises a set of fixed slats and a set of slidable slats disposed longitudinally from the top portion of the bed to the bottom portion of the bed.

37. The system of claim 36 in which said slidable slats are connected to a series of spaced horizontally running shuffle slat supports.

38. The system of claim 37 in which said shuffle slat supports are connected to at least one shuffle slat support tie bar running longitudinally from the top portion of the bed to the bottom portion of the bed.

39. The system of claim 38 in which said drive means further includes means for driving said shuffle slat support tie bar longitudinally back and forth.

40. The system of claim 39 in which said drive means includes a motor connected to a drive shaft and means, attached to the drive shaft, for converting rotating motion to linear motion.

41. The system of claim 40 further including at least one tie rod connected on one end to said means for converting and attached on the other end to said shuffle slat support tie bar.

42. The system of claim 41 in which said tie rod is connected to said shuffle slat support tie bar via an upper most shuffle slat support.

43. The system of claim 40 in which said motor is connected to said controller and said means for adjusting the rate of material processed through the dryer includes means for operating said motor for different periods of time.

44. The system of claim 43 in which said means for detecting includes means for sensing when the top portion of the bed contains sufficient material to be dried.

45. The system of claim 43 in which said means for detecting includes means for sensing the amount of material in the surge bin.

46. An automatic system for drying high moisture content material from a source, the system comprising:

a dryer including a bed inclined upwards from the bottom portion thereof to the top portion thereof, and drive means for urging material downward from the top portion to the bottom portion of the bed;

a first material feed system for transporting the high moisture content material from the source to the top portion of the bed, said first material feed system including a surge bin disposed between the source and the dryer for assuring a constant supply of material to the dryer for constant operation thereof;

means for detecting the amount of material delivered to the surge bin;

a controller, responsive to the means for detecting, including means for adjusting the rate of material transferred from the surge bin to the dryer; and a second material feed system for transporting back to the surge bin any excess material delivered by the first material feed system to the top portion of the dryer.

47. The system of claim 46 in which said means for detecting includes means for sensing any excess material transferred by the second material feed system back to the surge bin.

48. The system of claim 47 in which said controller is connected to said means for sensing and said dryer drive means and the controller includes means for operating said dryer drive means when excess material is detected being delivered back to the surge bin.

49. The system of claim 48 in which said controller includes means for operating said dryer drive means only when excess material is detected as being transported back to the surge bin.

50. The system of claim 46 in which said means for detecting includes means for sensing the amount of material in the surge bin.

51. The system of claim 50 in which said first material feed system is operable at at least two speeds and said controller includes means for switching between said at least two speeds in response to the amount of material in the surge bin.

52. The system of claim 46 in which said dryer bed includes a series of slats disposed longitudinally along the length of the bed, alternate slats being longitudinally slidable with respect to adjacent slats, and said drive means including means for propelling said slidable slats back and forth to shuffle material on the bed downward.

53. The system of claim 52 in which said controller includes means for operating said means for propelling for variable periods of time.

54. The system of claim 52 in which said adjacent slats overlap each other for preventing material from falling between adjacent slats.

55. The system of claim 54 in which said adjacent slats define longitudinal air gaps therebetween for passing air through material disposed on the bed.

56. The system of claim 52 in which the drive means further includes a picker mechanism disposed along the bottom portion of the bed for discharging material off the bottom portion of the bed and a motor for operating said picker mechanism.

57. The system of claim 56 in which said controller includes means for operating said picker motor for variable periods of time.

58. The system of claim 46 in which said dryer bed includes a series of slidable slats disposed longitudinally along the length of the bed and a slat drive motor for propelling said slidable slats back and forth to shuffle material on the bed downward.

59. The system of claim 58 in which said means for detecting includes means for sensing when the top portion of the bed contains sufficient material to be dried, said controller is connected to said slat drive motor and said means for sensing, said controller including means for operating said slat drive motor only when said means for sensing indicates that the top portion of the bed contains sufficient material to be dried.

60. The system of claim 58 in which said means for detecting includes means for signaling two different amounts of material in the surge bin, said controller is connected to said slat drive motor and said means for sensing, said controller including means for operating said slat drive motor for a first period of time in response to a signal indicative of a first amount of material in the surge bin and for operating said slat drive motor for a second period of time in response to a signal indicative of a second amount of material in the surge bin.

61. The system of claim 58 in which said dryer further includes a picker mechanism disposed along the bottom of the bed for discharging material off the bottom portion of the bed and a motor for operating the picker mechanism.

62. The system of claim 61 in which said means for detecting includes means for sensing when the top portion of the bed contains sufficient material to be dried, said controller is connected to the picker drive motor and the means for sensing, said controller including means for operating the picker drive motor only when said means for sensing indicates that the top portion of the bed contains sufficient material to be dried.

63. The system of claim 62 in which the means for detecting includes means for signaling two different amounts of material in the surge bin, the controller is connected to the picker drive motor and the means for sensing, the controller including means for operating the picker drive motor for a first period of time in response to a signal indicative of a first amount of material in the surge bin and for operating the picker drive motor for a second period of time in response to a signal indicative of a second amount of material in the surge bin.

64. The system of claim 46 further including at least one of: a sensor for signaling an overfilled surge bin, a sensor for signaling an empty surge bin, and a sensor for signaling an overfilled disposal site, said sensors connected to said controller, said controller further including means for stopping the operation of said first material feed system in response to a signal from any one said sensors.

65. The system of claim 58 in which said means for detecting includes means for signaling when the top portion of the dryer bed contains sufficient materials to be dried, said controller is connected to the slat drive motor and to the means for sensing, said controller including:

means for operating said slat drive motor at one feed rate in response to a signal from said means for signaling;

a timer for counting the time between successive signals from said means for signaling; and means for adjusting said feed rate in response to the counter.

66. The system of claim 65 in which said means for adjusting includes means for increasing said feed rate in response to a time count from the timer corresponding to a minimum count.

67. The system of claim 65 in which said means for adjusting includes means for decreasing said feed rate in response to a time count from the timer corresponding to a maximum count.

68. The system of claim 65 in which said dryer further includes a picker mechanism disposed along the bottom of the bed for discharging material off the bottom portion of the bed and a motor for operating said picker mechanism.

69. The system of claim 68 in which said means for detecting includes means for signaling when the top portion of the bed contains sufficient material to be dried, said controller is connected to the picker drive motor, and said means for sensing, said controller including:

means for operating the picker drive motor at a first feed rate in response to a signal from the means for signaling;

a timer for counting the time between successive signals from said means for signaling; and means for adjusting said first feed rate in response to the timer.

* * * * *